US007537310B2

(12) United States Patent
Konno et al.

(10) Patent No.: US 7,537,310 B2
(45) **Date of Patent: *May 26, 2009**

(54) INK JET PRINTING APPARATUS, INK JET PRINTING METHOD, AND INK JET PRINT HEAD

(75) Inventors: Yuji Konno, Kanagawa (JP); Hiroshi Tajika, Kanagawa (JP); Daisaku Ide, Tokyo (JP); Takeshi Yazawa, Kanagawa (JP); Atsuhiko Masuyama, Kanagawa (JP); Akiko Maru, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 229 days.

This patent is subject to a terminal disclaimer.

(21) Appl. No.: 11/153,341

(22) Filed: Jun. 16, 2005

(65) Prior Publication Data

US 2005/0231550 A1 Oct. 20, 2005

Related U.S. Application Data

(62) Division of application No. 10/647,377, filed on Aug. 26, 2003, now Pat. No. 7,090,332.

(30) Foreign Application Priority Data

Aug. 28, 2002 (JP) ..... 2002-249705
Jul. 25, 2003 (JP) ..... 2003-280338

(51) Int. Cl.
*B41J 2/205* (2006.01)

(52) U.S. Cl. ..... 347/43; 347/40; 347/41

(58) Field of Classification Search ..... 347/15, 347/43, 40, 41, 12
See application file for complete search history.

(56) References Cited

U.S. PATENT DOCUMENTS 4,528,576 A 7/1985 Koumura et al.

(Continued)

FOREIGN PATENT DOCUMENTS

EP 1 038 688 9/2000

(Continued)

OTHER PUBLICATIONS

HSV Lab Report, "Display Colors by Red-Green-Blue or Hue-Saturation-Value", efg's Computer Lab, http://www.efg2.com/Lab/Graphics/Colors/HSV.htm, Jul. 19, 2006.

(Continued)

*Primary Examiner*—Lamson D Nguyen
(74) *Attorney, Agent, or Firm*—Fitzpatrick, Cella, Harper & Scinto

(57) ABSTRACT

For a horizontally arranged print head, in which nozzle rows are arranged parallel with a scanning direction of the print head, two of a plurality of ink colors used, which have the greatest hue difference, are selected. Between the nozzle rows for these two colors, at least two nozzle rows for other colors are arranged so that the nozzle rows for the two colors have a large inter-nozzle-row distance. The resulting print head is used for printing. If cyan, light cyan, magenta, light magenta, yellow, and black are used as ink colors, the light cyan, black, yellow, and light magenta inks are arranged between the cyan and magenta inks, having a great hue difference.

14 Claims, 14 Drawing Sheets

U.S. PATENT DOCUMENTS

| | | | | |
|---|---|---|---|---|
| 4,952,942 | A | 8/1990 | Kanome et al. | |
| 5,825,377 | A | 10/1998 | Gotoh et al. | |
| 6,264,305 | B1 | 7/2001 | Inui et al. | |
| 6,382,757 | B1 | 5/2002 | Kakutani | 347/15 |
| 6,578,943 | B2 * | 6/2003 | Arquilevich et al. | 347/15 |
| 7,090,332 | B2 * | 8/2006 | Konno et al. | 347/43 |
| 7,093,926 | B2 * | 8/2006 | Gil | 347/43 |
| 2001/0015745 | A1 | 8/2001 | Onishi et al. | |
| 2002/0008729 | A1 | 1/2002 | Kaneko et al. | |
| 2002/0018087 | A1 | 2/2002 | Konno et al. | |
| 2002/0060718 | A1 | 5/2002 | Welten et al. | |
| 2002/0105557 | A1 * | 8/2002 | Teshigawara et al. | 347/15 |
| 2002/0113758 | A1 | 8/2002 | Nishikori et al. | |
| 2004/0041868 | A1 | 3/2004 | Maru et al. | |

FOREIGN PATENT DOCUMENTS

| | | | |
|---|---|---|---|
| EP | 1 072 421 | 1/2001 | |
| JP | 3-189167 | 8/1991 | 347/43 |
| JP | 2001-171119 | 6/2001 | |

OTHER PUBLICATIONS

Color Models and Color Wheels, http://personales.upv.es/~gbenet/teoria%20del%20color/water_color//color6.html#LAB2, Jan. 12, 2002.

Kleurencirkel, http://nl.wikipedia.org/wiki/Kleurencirkel, Jul. 19, 2006.

* cited by examiner

| FIRST COLOR | SECOND COLOR | ALLOWABLE INTER-COLOR DISTANCE |
|---|---|---|
| C | LC | 1 |
| | M | 5 |
| | LM | 4 |
| | Y | 3 |
| LC | M | 4 |
| | LM | 2 |
| | Y | 2 |
| M | LM | 1 |
| | Y | 2 |
| LM | Y | 1 |

FIG.9

INK JET PRINTING APPARATUS, INK JET PRINTING METHOD, AND INK JET PRINT HEAD

This application is a division of application Ser. No. 10/647,377 filed Aug. 26, 2003.

This application claims priority from Japanese Patent Application Nos. 2002-249705 filed Aug. 28, 2002 and 2003-280338 filed Jul. 25, 2003, which are incorporated hereinto by reference.

BACKGROUND OF THE INVENTION

1. Field of the Invention

The present invention relates to an ink jet printing apparatus that carries out color printing using a plurality of inks, and an ink jet print head used in this ink jet printing apparatus. Specifically, the present invention relates to an ink jet printing apparatus that carries out printing by causing a print head to execute a main scan, the print head comprising a plurality of nozzle rows each of which ejecting different colors, extending in a predetermined direction and arranged along a main scanning direction orthogonal to the predetermined direction, as well as an ink jet print head used in this ink jet printing apparatus.

2. Description of the Related Art

Ink jet printing apparatuses have been spreading rapidly because of their relatively small sizes, low noise, low costs required for color printing, and the like. Furthermore, recent ink jet printing apparatuses can achieve high image quality and operate at high speeds: they can output an A4-sized image of a photographic quality within about one minute. This is mainly due to technical improvements in print heads, ink, and print media, but another likely reason for the improved performance of these apparatuses is the mechanical control of the main body of the apparatus and the like.

The recent ink jet printing apparatuses are commonly of a general type that prints a print medium by alternately repeating a printing operation of moving a print head on the print medium in a main scanning direction (this operation will hereinafter be referred to as a "main scan") and ejecting ink during this scan and a sheet feeding operation of conveying the print medium by a specified amount in a direction perpendicular to the main scanning direction (this operation will hereinafter be referred to as a "sub-scan"). The time required by these serial type ink jet printing apparatuses for printing varies significantly depending on, for example, the scan control of the print head.

The configuration of the print head in the serial type color printing apparatus is roughly classified into two types.

In a first type of print head (vertically arranged head), a large number of nozzles are linearly arranged in a sub-scanning direction as shown in FIGS. 11A and 11B. In FIG. 11A, rows of color nozzles through which yellow, magenta, cyan, and black inks, respectively, are ejected are arranged in a line in a sheet feeding direction so that the rows do not overlap one another. Further in FIG. 11B, a row of black nozzles through which black ink is ejected is constructed separately from color nozzle rows through which color inks are ejected.

For example, if the arrangement shown in FIG. 11B is used to execute color printing, the color inks are ejected in accordance with print data. However, a single main scan only forms ink dots of each color on a print medium at different positions. Then, to form secondary colors, dots of secondary colors must impact the same area on the print media. Accordingly, the sheet is fed by an amount corresponding to a row of nozzles, i.e. the length shown at h in the figure. Therefore, the print head scans the same area on the print medium about three times. Further, the nozzle rows always scan the same area on the print medium in the order of cyan, magenta, and yellow regardless of the scanning direction of the print head. Accordingly, in forming blue, red, and green, what is called "secondary colors", the colors are allowed to overlap one another in a fixed order regardless of the scanning direction of the print head (e.g. forward direction or back direction). For example, to form a blue image, cyan is printed first and magenta is then printed on it. Consequently, the use of the illustrated print head prevents the colors from being non-uniformly printed colors even if an image is printed by alternately scanning the print head forward and backward, i.e. even if what is called "bidirectional printing" is carried out.

However, with the illustrated head arrangement, if the number of nozzles is increased to increase printing speed, then the print head becomes longer to increase the size of the head or the whole apparatus. In another case, a method of holding a print medium in a printing section tends to be complicated. This disadvantageously increases the costs of the print head or the whole apparatus.

In a second type of a print head (horizontally arranged head), ejecting sections, from which black ink, cyan ink, magenta ink, and yellow ink, respectively, are ejected, are arranged in parallel with the main scanning direction, for example, as shown in FIG. 12. With a print head in this form, a single scan allows all the color inks to be ejected to the same area on a print medium in accordance with image data.

It is assumed that ink is ejected from the print head not only during a forward scan (the direction of arrow A in the figure) but also during a backward scan (the direction of arrow B in the figure) in order to increase the printing speed. Then, in forming blue, red, and green, what is called "secondary colors", the order in which the colors are allowed to overlap one another differs between the forward scan (the direction of arrow A in the figure) and backward scan (the direction of arrow B in the figure) of the print head. As a result, tints vary among the different scan operations to make the colors non-uniform, thus significantly degrading the image. The non-uniformity is particularly significant in a high-gradation image such as solid printing.

On the other hand, a multipass printing method is available for improving the quality of the image. With this method, differences among the nozzles characteristic of the head are reduced by printing the same area using two or more scan operations. In this case, the distance a print medium is moved during a single operation is equal to or smaller than the length of the head. Accordingly, the multipass printing method requires a larger number of scan operations than the other methods and thus generally requires more time for printing. Thus, in order to reduce the printing time, reciprocatory printing can be effectively used even if an image is formed using the multipass printing method. On the other hand, the color non-uniformity (the color variations) resulting from a difference in color overlapping order between forward printing and backward printing is not completely avoided even when the multipass printing method is used. It is possible to increase the number of passes to make the color non-uniformity almost unnoticeable. However, more time is required for printing. Consequently, the reciprocatory printing, which is used to reduce the time required for printing, becomes meaningless.

Further, as shown in FIG. 13, to form a higher-quality image, a 6-color print head may be used in which ink ejecting sections for black ink, cyan ink, magenta ink, and yellow ink, as well as light cyan and light magenta ink are arranged parallel with one another. Even with this 6-color print head, color non-uniformity may be caused by a difference in color overlapping order between forward printing and backward printing, as with the 4-color print head in FIG. 12.

As described above, there are two types of print head arrangements suitable for an ink jet printing apparatus that carries out color printing: an arrangement (vertically arranged head) in which the nozzle rows for the respective ink colors are arranged in a line and an arrangement (horizontally arranged head) in which the nozzle rows are arranged parallel with one another. The parallel arrangement is suitable for high-speed printing. However, with this arrangement, color non-uniformity may be caused by a difference in color overlapping order between forward printing and backward printing.

To solve this problem, Japanese Patent Application Laid-open No. 2001-171119 describes a print head in which nozzle rows for color inks are arranged symmetrically in the main scanning direction. According to this invention, ink is allowed to impact print media in the same order at all times by changing ejecting nozzle rows between a forward scan and a backward scan. This arrangement enables to resolve color non-uniformity resulting from a difference in ink impacting order.

However, even an ink jet printing apparatus using a print head in which nozzle rows are symmetrically arranged has the following problem.

With this arrangement, a plurality of nozzle rows are required for the same color, thus increasing the size of the head. Furthermore, an electric or mechanical system in this arrangement requires more wires than the other conventional electric or mechanical systems. This increases the costs of the apparatus. Furthermore, if the above described arrangement is provided using six color inks including light cyan and light magenta, 12 (6 colors×2) nozzles are required. As a result, the sizes of the head and the whole apparatus increase sharply, and an ink channel arrangement becomes very complicated. It is also likely that sufficient suction is impossible during a suction and recovery process. This also degrades the reliability of the apparatus.

SUMMARY OF THE INVENTION

The present invention is provided in view of the above described conventional problem. It is an object of the present invention to provide an ink jet printing apparatus that can minimize color non-uniformity resulting from a difference in ink overlapping order that may occur during reciprocatory printing, while minimizing increases in the sizes of a print head and an ink jet printing apparatus and in costs.

To achieve this object, the present invention provides an ink jet printing apparatus that prints a print medium by causing a printing section including color nozzle rows corresponding to a plurality of four or more colors to carry out a main scan in a main scanning direction, while causing the printing section to eject ink onto the print medium, the apparatus being characterized in that a nozzle row for a first ink color and a nozzle row for a second ink color are arranged at opposite ends of the printing section in the main scanning direction, the first and second ink colors having the largest hue difference among the plurality of colors.

Further, the present invention provides an ink jet printing apparatus that prints a print medium by causing a printing section having nozzle rows corresponding to respective colors and each composed of a plurality of nozzles arranged in a predetermined direction to carry out a main scan in a direction orthogonal to the predetermined direction, while causing the printing section to eject ink onto the print medium during the scan, the apparatus being characterized in that in the direction orthogonal to the predetermined direction, between nozzle rows for a first and second ink colors having the largest hue difference from each other among the plurality of colors, nozzle rows for at least two colors other than the first and second colors are arranged.

Furthermore, the present invention provides an ink jet printing apparatus that prints a print medium by causing a printing section comprising color nozzle rows corresponding to a plurality of colors including black to carry out a main scan in a main scanning direction, while causing the printing section to eject ink onto the print medium, the apparatus being characterized in that a nozzle row for a first ink color and a nozzle row for a second ink color are arranged at opposite ends of the printing section in the main scanning direction, a hue difference between the first and second ink colors being the largest hue among the plurality of colors, and a nozzle row for black ink is sandwiched between the nozzle row for the first ink color and the nozzle row for the second ink color.

Moreover, the present invention provides an ink jet printing apparatus that prints a print medium by causing a printing section comprising color nozzle rows corresponding to black and a plurality of color inks to carry out a main scan in a main scanning direction, while causing the printing section to eject ink onto the print medium, the apparatus being characterized in that along the main scanning direction, a nozzle row for a first ink color and a nozzle row for a second ink color are arranged at the largest distance from each other among the nozzle rows for the color inks, the first and second ink colors being included in the color inks and having the largest hue difference from each other among the color inks.

Further, the present invention provides an ink jet printing method of printing a print medium by causing a printing section including color nozzle rows corresponding to a plurality of four or more colors, respectively, to carry out a main scan in a main scanning direction, while causing the printing section to eject ink onto the print medium, the method being characterized in that a nozzle row for a first ink color and a nozzle row for a second ink color are arranged at opposite ends of the printing section in the main scanning direction, a hue difference between the first and second ink colors being the largest among the plurality of colors.

Further, the present invention provides an ink jet printing method of printing a print medium by causing a printing section having nozzle rows corresponding to respective colors and each composed of a plurality of nozzles arranged in a predetermined direction to carry out a main scan in a direction orthogonal to the predetermined direction, while causing the printing section to eject ink onto the print medium during the scan, the method being characterized in that in the direction orthogonal to the predetermined direction, between nozzle rows for a first and second ink colors having the largest hue difference from each other among the plurality of colors, nozzle rows for at least two colors other than the first and second colors are arranged.

Furthermore, the present invention provides an ink jet printing method of printing a print medium by causing a printing section comprising color nozzle rows corresponding to a plurality of colors including black, respectively, to carry out a main scan in a main scanning direction, while causing the printing section to eject ink onto the print medium, the method being characterized in that a nozzle row for a first ink color and a nozzle row for a second ink color are arranged at opposite ends of the printing section in the main scanning direction, the first and second ink colors having the largest hue difference from each other among the plurality of colors, and a nozzle row for black ink is sandwiched between the nozzle row for the first ink color and the nozzle row for the second ink color.

Moreover, the present invention provides an ink jet printing method of printing a print medium by causing a printing section comprising color nozzle rows corresponding to black and a plurality of color inks, respectively, to carry out a main scan in a main scanning direction, while causing the printing section to eject ink onto the print medium, the method being characterized in that along the main scanning direction, a nozzle row for a first ink color and a nozzle row for a second ink color are arranged at the largest distance from each other among the nozzle rows for the color inks, the first and second ink colors being included in the color inks and having the largest hue difference from each other among the color inks.

The present invention provides an ink jet print head including color nozzle rows corresponding to a plurality of four or more colors, the print head being characterized in that each of the color nozzle rows is composed of a plurality of nozzles arranged in a first direction, and a nozzle row for a first ink color and a nozzle row for a second ink color are arranged at opposite ends in a second direction orthogonal to the first direction, a hue difference between the first and second ink colors being the largest among the plurality of colors.

Further, the present invention provides an ink jet print head having nozzle rows corresponding to respective colors and each composed of a plurality of nozzles arranged in a first direction, the print head being characterized in that in a second direction orthogonal to the first direction, between nozzle rows for a first and second ink colors having the largest hue difference from each other among the plurality of colors, nozzle rows for at least two colors other than the first and second colors are arranged.

Furthermore, the present invention provides an ink jet print head comprising color nozzle rows corresponding to a plurality of colors including black, the print head being characterized in that each of the color nozzle rows is composed of a plurality of nozzles arranged in a first direction, in that a nozzle row for a first ink color and a nozzle row for a second ink color are arranged at opposite ends in the second direction orthogonal to the first direction, a hue difference between the first and second ink colors being the largest among the plurality of colors, and in that a nozzle row for black ink is sandwiched between the nozzle row for the first ink color and the nozzle row for the second ink color.

Moreover, the present invention provides an ink jet print head comprising color nozzle rows corresponding to black and a plurality of color inks, the print head being characterized in that each of the color nozzle rows is composed of a plurality of nozzles arranged in a first direction, and along a second direction orthogonal to the first direction, a nozzle row for a first ink color and a nozzle row for a second ink color are arranged at the largest distance from each other among the nozzle rows for the color inks, the first and second ink colors being included in the color inks and having the largest hue difference from each other among the color inks.

The above arrangements employ printing means (or an ink ejecting section) configured so that between nozzle rows (for example, a magenta nozzle row and a cyan nozzle row) for the two colors having the largest hue difference among the color inks, other nozzle rows (for example, a light-magenta nozzle row and a light-cyan nozzle row or a black nozzle row and a yellow nozzle row) for at least two colors are arranged so as to be sandwiched between the above two nozzle rows. Accordingly, if secondary colors are formed using the two colors having the largest hue difference, a sufficient time is available after one (for example, cyan) of the inks which is ejected first has impacted a print medium and before the other ink (for example, magenta) impacts the print medium. This markedly reduces color non-uniformity compared to the form in which nozzle rows for colors having the largest hue difference are arranged in close proximity (for example, the nozzle rows are adjacent to each other or are not located at the opposite ends).

The term "nozzle row" as used herein refers to a plurality of nozzles arranged in a predetermined direction and through which ink is ejected.

The term "printing section (ink ejection section)" as used herein refers to an arrangement including color nozzle rows corresponding to ink colors. These color nozzle rows may be integrally provided in the same print head or may be provided in an arbitrary number of different print heads. Here, the form in which the color nozzle rows are provided in different print heads is not limited to the arrangement in which the color nozzle rows are provided in the different print heads but also the arrangement in which at least one of the color nozzle rows is provided in a print head different from the one in which the remaining color nozzles are provided.

Further, in the form in which the color nozzle rows included in the printing section (or ink ejecting section) are integrally provided in the same print head, the color nozzle rows may be constructed in a single chip or in a plurality of different chips. If for example, six nozzle rows are present which correspond to cyan (C), magenta (M), yellow (Y), black (K), light cyan (LC), and light magenta (LM), these nozzle rows for the six colors may be provided in one chip. Alternatively, the nozzle rows for the six colors may be independently provided in different chips. In this case, a nozzle row for one color is provided in each chip, so that six chips are used in total. Furthermore, one of the 6-color nozzle rows for a particular color (for example, K) may be provided in one chip, while the color nozzles for the other colors (for example, C, M, Y, LC, and LM) may be provided in another chip. Alternatively, the six colors may be divided into three pairs each of two colors (for example, C and LC, K and Y, and LM and M) so that the corresponding nozzle rows can be provided in three different chips. If the color nozzle rows included in the printing section (or the ink ejecting section) are provided in different print heads, it goes without saying that at least one of the color nozzle rows is formed in a different chip.

The term "tint difference (color difference)" as used herein refers to $\Delta E$ that is a color difference in a CIE1976L*a*b* color space (hereinafter simply referred to as a "CIELab space"), an international standard.

Further, the term "hue difference" refers to a difference in hue angle corresponding to two colors on an a*b* plane in the CIELab color space. That is, when two colors are assumed to have hue angles H1 and H2, respectively, a hue difference $\Delta H$ corresponds to $|H1-H2|$ that is a difference in hue angle between the two colors, i.e. $\Delta H=|H1-H2|$.

In this case, the hue angle H refers to an angle on an a*b* plane and $H=\tan^{-1}(b^*/a^*)$. That is, if one of the colors has a colorimetric value (a*b*) of $(a_1^*b_1^*)$ and the other has a colorimetric value (a*b*) of $(a_2^*b_2^*)$, then the first color has a hue angle H1 of $\tan^{-1}(b_1^*/a_1^*)$, while the second color has a hue angle H2 of $\tan^{-1}(b_2^*/a_2^*)$. Therefore, the hue difference between the two colors (first and second colors) can be determined by $DH=|\tan^{-1}(b_1^*/a_1^*)-\tan^{-1}(b_2^*/a_2^*)|$.

The above and other objects, effects, features and advantages of the present invention will become more apparent from the following description of embodiments thereof taken in conjunction with the accompanying drawings.

BRIEF DESCRIPTION OF THE DRAWINGS

FIG. 9 is a table showing the results of evaluation of allowable inter-color distances based on differences between ink colors;

DETAILED DESCRIPTION OF PREFERRED EMBODIMENTS

Embodiments of the present invention will be described below with reference to the drawings.

Embodiment 1

Figure 1:
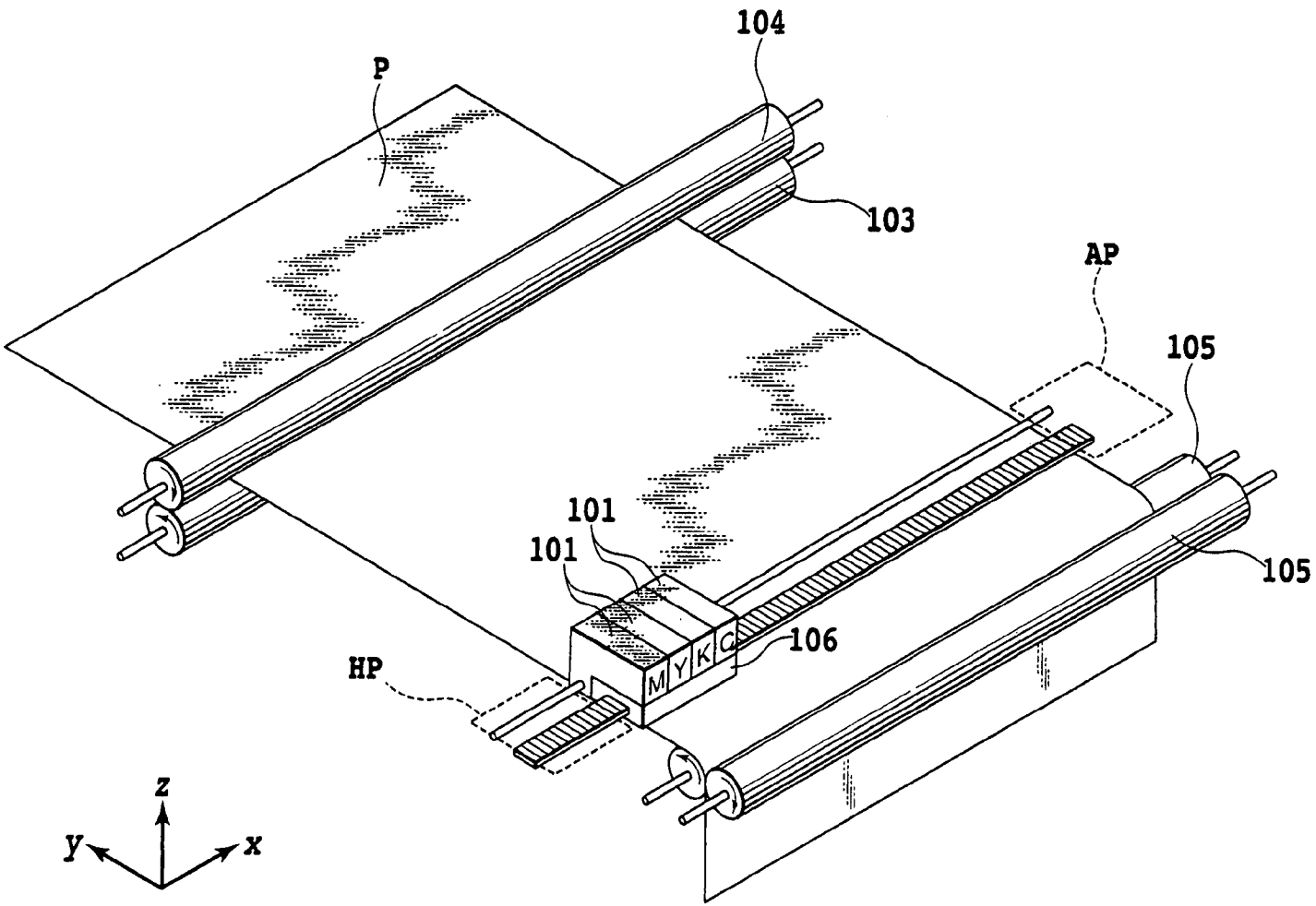
FIG. 1 is a perspective view of an ink jet printing apparatus according to an embodiment of the present invention.

FIG. 1 is a perspective view of an ink jet printing apparatus according to the present embodiment.

Reference numeral 101 denotes ink tanks in each of which ink passes through an ink path (not shown) and communicates with a print head 102. The print head 102 is provided so as to face a print medium P. The ink tanks 101 and the print head 102 are mounted on a carriage 106, and this print head unit (including the ink tanks 101, the print head 102, and the carriage 106) is stopped at a home position HP during non-printing. During printing, the carriage 106 moves in the direction of arrow X from the home position along a guide rail 107. During this movement, ink is ejected from the print head 102 for printing. A reference position located opposite the home position across the print medium in the direction of arrow X is called an "away position AP". When the carriage 106 moves to an away position side end of the print medium P, a sheet feeding roller 105 is rotated to convey the print medium by a specified amount in the direction of arrow Y. As the sheet feeding roller 105 rotates, conveying rollers 103 and 104 are rotated to feed the print medium in a sheet discharging direction. The entire print medium P can be printed by alternately repeating a printing operation achieved by moving the print head 192 and a sheet feeding operation achieved by rotating the conveying rollers 103 and 104.

The ink tanks 101 are arranged in the direction of arrow X (main scanning direction) from the home position in the order of magenta, yellow, black, and cyan. The color nozzle rows are arranged in the main scanning direction of the print head 102 in the same order as that of the ink tank 101.

Figure 2:
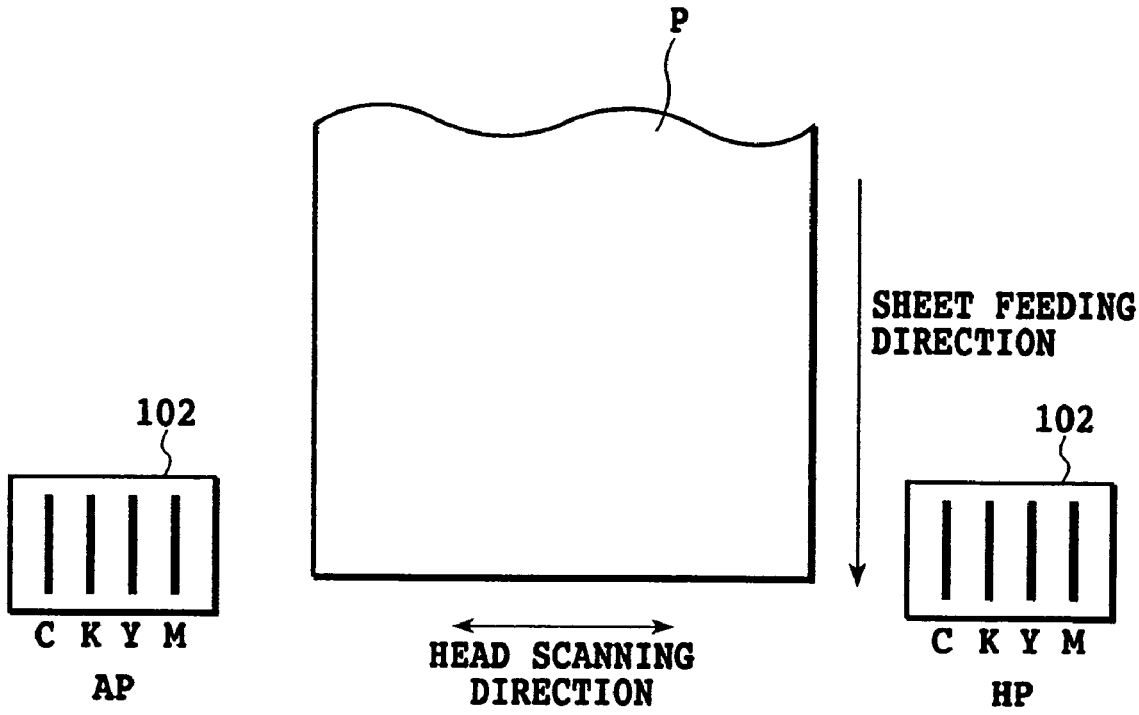
FIG. 2 is a schematic view showing an arrangement of nozzle rows in a print head according to Embodiment 1.

FIG. 2 is a schematic diagram showing nozzle rows in the print head.

Rows of color nozzles through which cyan (C), black (K), yellow (Y), and magenta (M) inks, respectively, are ejected are arranged parallel with one another in a direction almost orthogonal to the direction in which the nozzles are arranged, i.e. in the main scanning direction. The nozzle rows are each composed of a plurality of nozzles arranged in a line or in a plurality of lines. Heaters that are electrothermal converters correspond to the respective nozzles. Each of the heaters is heated to generate bubbles in ink so that pressure generated by these bubbles can cause ink to be ejected in the form of droplets. In the present embodiment, a bubble jet (registered trade mark) method is used to allow ink to be ejected. However, a piezo method or the like may be used. In the present embodiment, a print head is used in which all color nozzle rows used are integrally formed. However, the present invention is not limited to this. The color nozzle rows may be provided in different print heads. Specifically, in the present embodiment, four color nozzle rows corresponding to cyan (C), magenta (M), yellow (Y), and black (K) are provided in one print head. However, these four color nozzle rows may be independently provided in different print heads. In this case, one color nozzle row is provided for each print head. Thus, four print heads are used in total. Furthermore, two of the four color nozzle rows for particular colors (for example, C and K) may be provided in one print head, while the other color nozzle rows for the other colors (for example, M and Y) may be provided in the other print head.

Further, in the present embodiment, the four color nozzle rows are formed in one head chip of the same print head. The present invention is not limited to this aspect. The color nozzle rows may be formed in different chips of the same print head. Specifically, in the present embodiment, the four nozzle rows corresponding to cyan (C), magenta (M), yellow (Y), and black (K) are provided in one head chip of one print head. However, these four nozzle rows may be independently arranged in different chips (in this case, one color nozzle row is provided for each chip, so that four chips are used in total). Furthermore, two of these four nozzle rows for particular colors (for example, C and K) may be provided in one of the head chips. The nozzle rows for the other colors (for example, M and Y) may be provided in the other head chip. If these four color nozzle rows are provided in different print heads, it should be appreciated that at least one of the color nozzles rows is formed in a different chip.

As described above, the present invention includes not only the form in which color nozzle rows corresponding to ink colors are provided in the same print head or the same chip but also the form in which the nozzle rows are provided in different print heads or different chips. Accordingly, to include both these forms, the present invention refers to an arrangement including color nozzle rows corresponding to ink colors, as a "printing section (or ink ejecting section)". The arrangement including color nozzle rows corresponding to ink colors will also be referred to as a "printing section (or ink ejecting section)" in a second to fourth embodiments, described later.

With the arrangement of the nozzle rows shown in FIG. 2, while the carriage is moving in the direction of arrow X, i.e. during a forward scan (a forward main scan), the inks are allowed to impact the same area on a print medium in the order of cyan, black, yellow, and magenta. For example, if cyan and magenta are used to produce a secondary color (blue) for color printing, cyan and then magenta are allowed to impact the print medium. On the other hand, while the carriage is moving from an away position side to a home position side, i.e. during a backward scan (a backward main scan), the inks are allowed to impact the same area on a print medium in the order of magenta, yellow, black, and cyan. If cyan and magenta are used to produce a secondary color (blue) as described above, magenta and then cyan are allowed to impact the print medium. That is, the order in which the inks overlap one another is reversed between a forward scan and a backward scan.

Figure 3A:
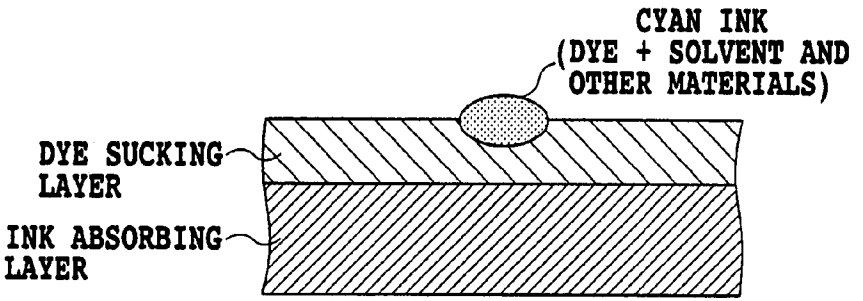
FIGS. 3A to 3F are schematic views showing how inks impact and are then fixed to a print medium in the order of cyan ink and magenta ink if there is a sufficient time interval between impacting of cyan ink and impacting of magenta ink.
Figure 3B:
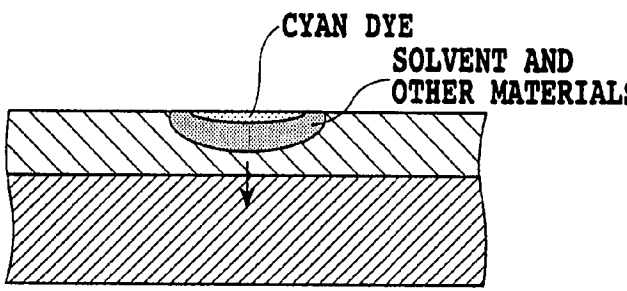
Figure 3C:
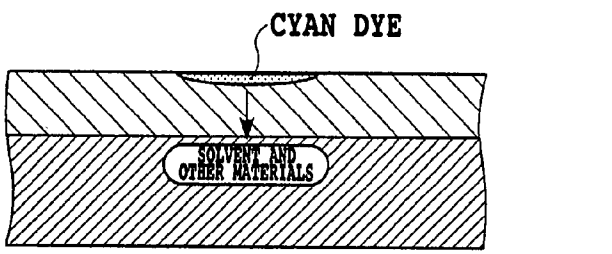

Now, with reference to FIGS. 3A to 3F, description will be given of the state observed after ink has impacted a print medium and before a dot is formed. These figures are sectional views of a print medium showing its surface impacted by ink. As shown in FIG. 3A, if the carriage is moving in the direction of arrow X as shown in FIG. 2, then cyan ink impacts the print medium first. The cyan ink is composed of a dye, a solvent, and water. When an ink droplet of the cyan ink impacts the print medium, the cyan dye is trapped at a position close to a front layer of a dye sucking layer as shown in FIG. 3B. On the other hand, the solvent, water, and materials other than water permeate toward the interior of the print medium. As shown in FIG. 3C, they pass through the dye sucking layer to reach an ink absorbing layer, where they are absorbed. Of course, it is needless to say that after the ink has impacted the print medium, small amounts of solvent, water, and others evaporate to the exterior.

Figure 3D:
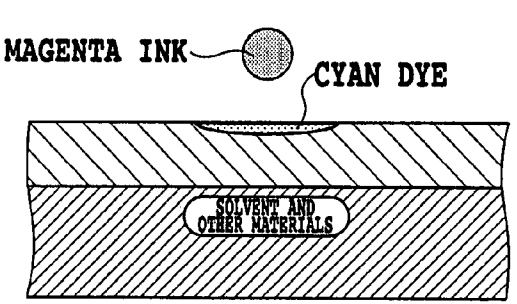
Figure 3E:
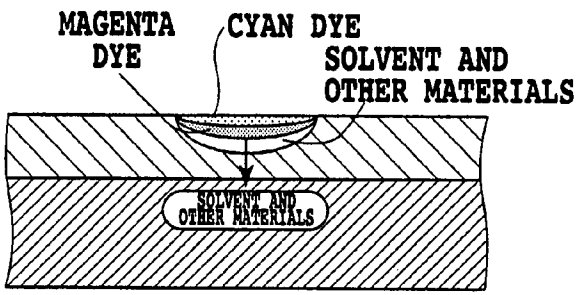
Figure 3F:
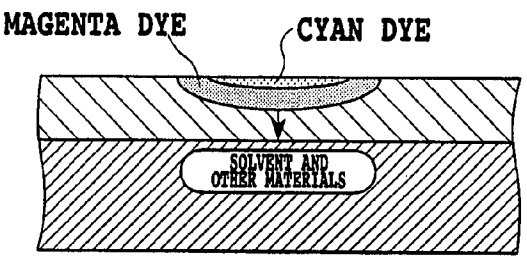

Then, as shown in FIG. 3D, after the cyan ink has been ejected, the magenta ink is ejected. As shown in FIG. 3E, the cyan dye has already been trapped in the front layer of the print medium, so that there is no longer a sufficient capacity to suck a magenta dye. Thus, the impacted magenta dye is trapped at a position in the dye sucking layer at which the cyan dye has not been trapped yet. Then, as shown in FIG. 3F, a solvent and materials other than the dye are absorbed by the ink absorbing layer. Since the magenta ink impacts the print medium after the solvent of the cyan ink has been absorbed by the ink absorbing layer, the magenta ink is fixed to the front layer so that the magenta dye is partly trapped in it and without soaking deep through the print medium.

Figure 14A:
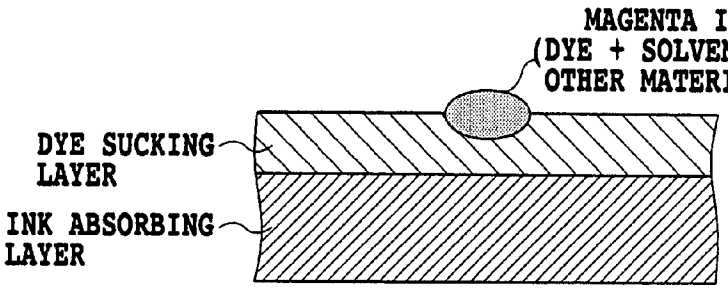
FIGS. 14A to 14F are schematic views showing how inks impact and are then fixed to a print medium in the order of magenta ink and cyan ink if there is a sufficient time interval between impacting of magenta ink and impacting of cyan ink.
Figure 14B:
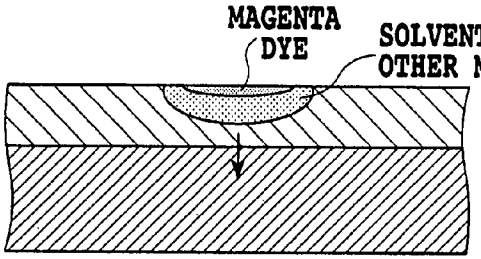
Figure 14C:
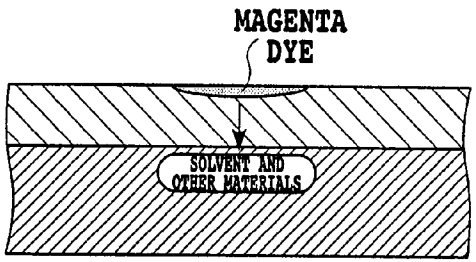
Figure 14D:
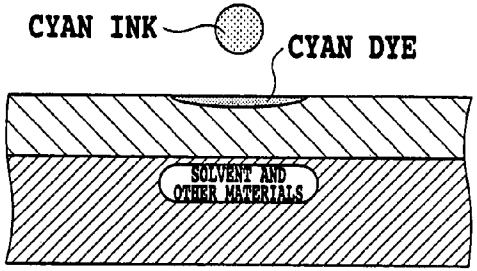
Figure 14E:
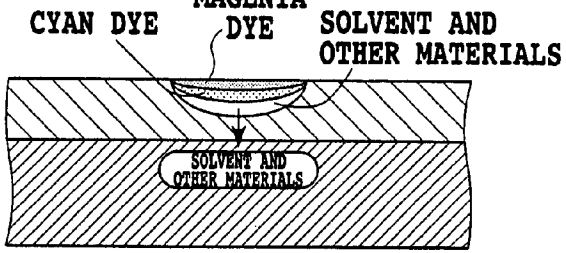

FIGS. 14A to 14B show the state observed during backward printing after ink has impacted a print medium and before a dot is formed, compared to FIGS. 3A to 3F showing an impacting cross-section observed during forward printing. Compared to FIG. 3F, in FIG. 14F, more dye from the previously impacted ink is fixed to the front layer of the medium than dye from the subsequently impacted ink. Thus, there occurs a difference in hue between dots.

In such a process of ink permeation, several dozen milliseconds of permeation time elapse after the dye has been trapped in the dye sucking layer and before the solvent and other materials are absorbed by the ink absorbing layer. The state (shown in FIGS. 4A to 4D) described below may occur if new ink impacts the print medium before the already impacted ink has not sufficiently permeated.

Figure 4A:
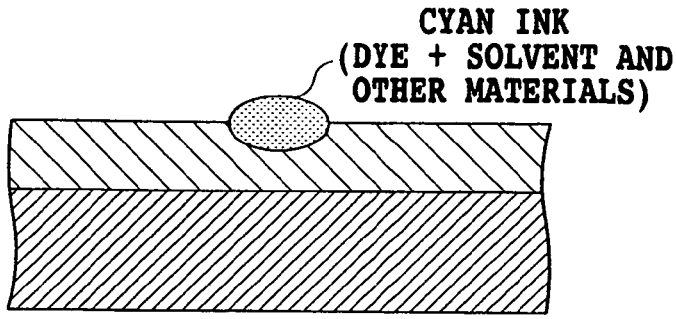
FIGS. 4A to 4D are schematic views showing how inks impact and are then fixed to a print medium in the order of cyan ink and magenta ink if there is an insufficient time interval between impacting of cyan ink and impacting of magenta ink.
Figure 4B:
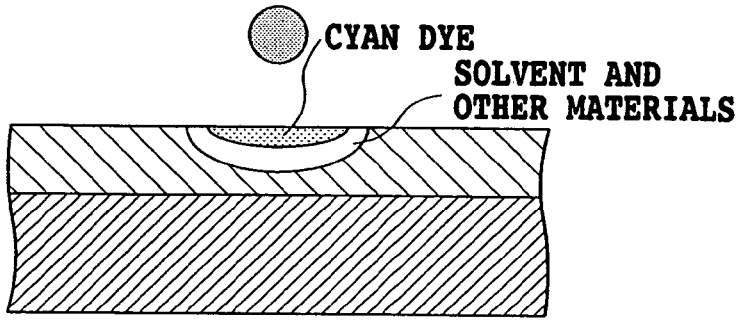
Figure 4C:
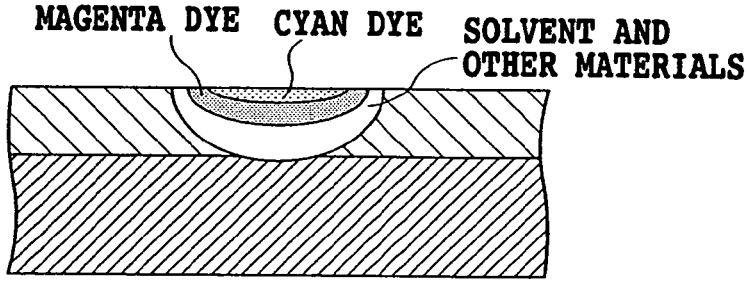
Figure 4D:
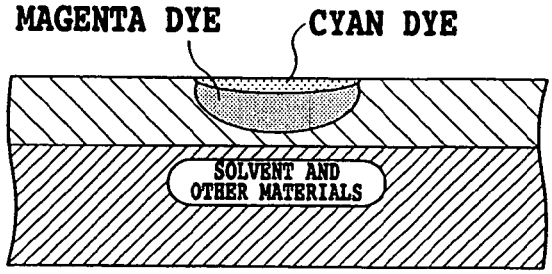
Figure 5A:
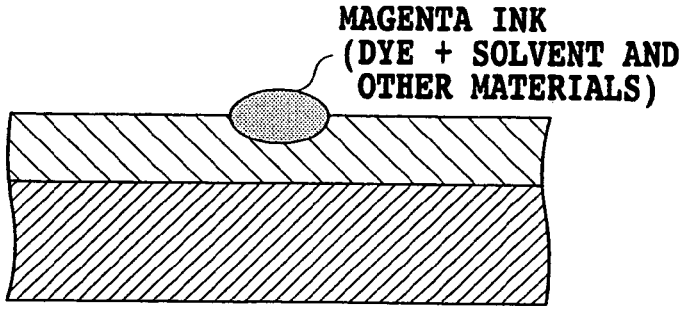
FIGS. 5A to 5D are schematic views showing how inks impact and are then fixed to a print medium in the order of magenta ink and cyan ink if there is an insufficient time interval between impacting of magenta ink and impacting of cyan ink.
Figure 5B:
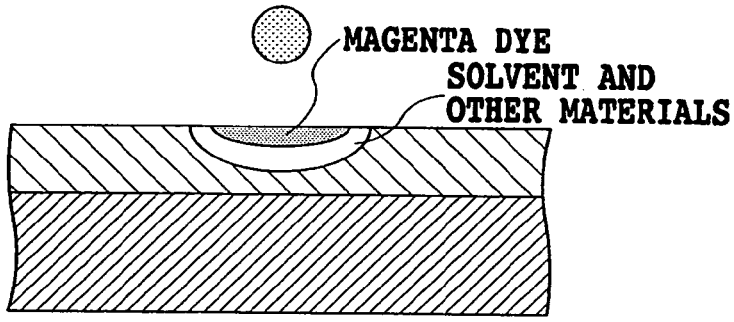
Figure 5C:
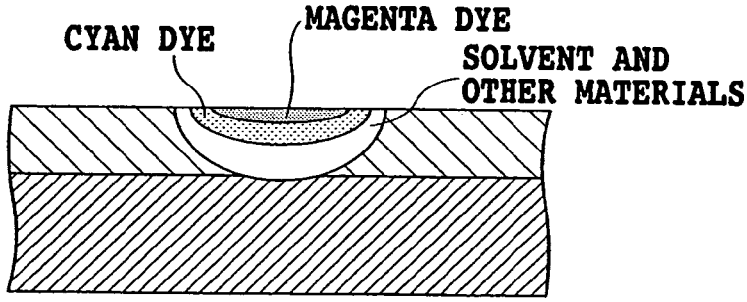
Figure 5D:
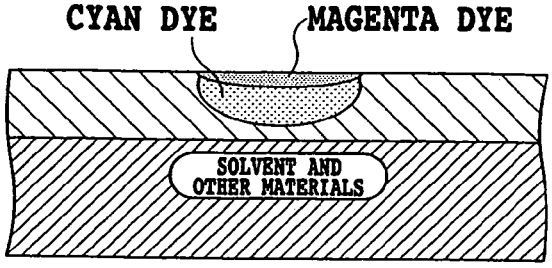

FIGS. 4A to 4D show that the magenta ink impacts the print medium before the cyan ink has not sufficiently permeated. If the magenta ink is allowed to impact the print medium while the solvent component of the previously impacted cyan ink has not sufficiently permeated down to the ink absorbing layer and remains in the dye sucking layer as shown in FIG. 4B, the solvent from the cyan ink and the solvent from the magenta ink remain in the dye sucking layer as shown in FIG. 4C. In this state, the amount of solvents is excessive. If the amount of solvents in the dye sucking layer is thus excessive, the surface tension of the ink, containing the solvent and the dye, increases relative to the force to suck the dye. Accordingly, as shown in FIG. 4D, more dye permeates into the ink absorbing layer in the medium together with the solvent component without being sucked into the dye sucking layer. Consequently, as a time interval in impacting between two different ink colors decreases, more dye components from the subsequently impacted ink are sucked toward the bottom layer of the print medium. As the dye sucking position lowers toward the bottom layer of the medium relative to its front layer, the dye contributes less and less to coloring.

FIGS. 5A to 5D show how cyan ink and magenta ink impact the print medium when the print head is scanned in the opposite direction compared to FIGS. 4A to 4D. That is, these figure show that the magenta ink and then cyan ink impact the print medium. As is apparent from a comparison of FIG. 4D with FIG. 5D, if there is only a small difference in impacting time between two colors, almost no dye from the subsequently impacted ink remains in the front layer of the print medium. As a result, there occurs a large difference in tint caused by ink overlapping order.

Figure 14F:
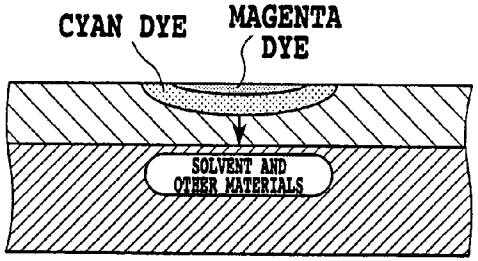

In the previously described impacting state shown in FIGS. 3F and 14F, in which there is a relatively large difference in ink impacting time, more of the subsequently impacted ink dye is fixed to the front layer of the medium to contribute to coloring to a certain degree. As a result, there occurs a relatively small difference in tint between a forward scan and a backward scan.

Therefore, when a secondary color is printed, it is effective to allow new ink to impact the print medium after the previously impacted ink has sufficiently permeated through the print medium, in order to reduce a difference in tint between a forward scan and a backward scan. Specifically, to reduce a "tint difference" resulting from a difference in ink overlapping order between a forward scan and a backward scan, it is important to take a time interval between two colors impacting into account. In other words, the tint difference is reduced by increasing the distance between the two color nozzle rows.

Figure 6:
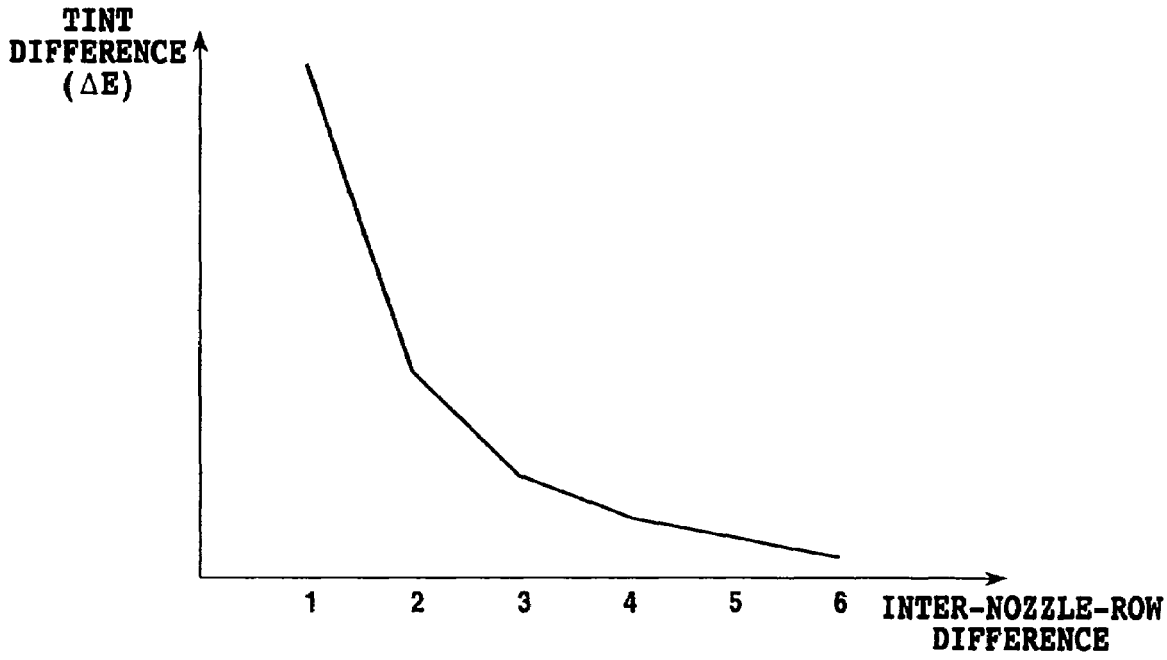
FIG. 6 is a graph showing the relationship between an inter-nozzle-row distance and a color difference.

This is apparent from FIG. 6. This figure shows the relationship between an inter-nozzle-row distance and the tint difference. In this case, for the inter-nozzle-row distance, the distance between adjacent nozzle rows is defined to be "1". Accordingly, if four nozzle rows corresponding to four colors C, M, Y, and K are arranged parallel with one another at equal intervals in the main scanning direction, the distance between two nozzle rows arranged at the largest distance from each other is "3". This figure shows a tint difference observed when cyan and magenta are used as two colors forming a secondary color. As is apparent from FIG. 6, as the distance between nozzle rows for the two colors forming a secondary color (blue) increases, the "tint difference" decreases, which results from a difference in the order of overlapping of inks for the secondary color formed. As described above, this is surely because the difference in impacting time increases with the inter-nozzle-row distance.

The phenomenon in which the tint is varied by a difference in the order of overlapping of inks for the secondary color may occur not only with the combination of cyan and magenta inks but also with the combination of other inks. However, the tint difference (color difference) caused by a difference in ink overlapping order varies depending on the combination of inks. The tint difference generally increases with a difference in hue between ink colors. Thus, to reduce the tint difference of a secondary color composed of two ink colors having a large hue difference, it is effective to set a large difference in ink impacting time between two colors having a large hue difference as shown in FIGS. 3A to 3F. Specifically, for two ink colors having a large hue difference, the corresponding nozzle rows should be arranged at as large a distance from each other as possible.

Thus, in the present embodiment, to arrange the nozzle rows for cyan and magenta, having the largest hue difference among yellow, cyan, magenta, at the largest distance from each other, the four color nozzle rows are arranged in the order of cyan, black, yellow, and magenta in a direction (main scanning direction) orthogonal to the direction (predetermined direction) in which the nozzles are arranged. That is, as shown in FIG. 2, in the main scanning direction, the color nozzle rows are arranged so that the nozzle rows for the two colors having the largest hue difference are located at the opposite ends of the arrangement. In this regard, black is rarely used to form a secondary color, so that the hue difference relationship can be determined among the color inks.

In a conventional horizontally arranged print head, the nozzle rows are often arranged in the order of cyan, magenta, yellow, and black in the main scanning direction. In this form, the nozzle rows for the two colors (cyan and magenta) having the largest hue difference from each other among a plurality of colors are arranged adjacent to each other. Thus, a time interval between the two colors impacting is relatively short. Correspondingly, there is a relatively large tint difference caused by a difference in ink overlapping order between a forward scan and a backward scan. On the other hand, in the present embodiment, the nozzle rows for the two colors (cyan and magenta) having the largest hue difference among a plurality of colors are arranged at the opposite ends of the arrangement, i.e. at the largest distance from each other. Consequently, there is a relatively large interval in impacting time between the two colors. This reduces the tint difference caused by a difference in ink overlapping order between a forward scan and a backward scan. As described above, the present embodiment suppresses the color non-uniformity of a secondary color composed of cyan and magenta compared to the use of a conventional print head.

Furthermore, as shown in FIGS. 4A to 4D and 5A to 5D, the color non-uniformity attributed to the ink overlapping order during reciprocatory printing relates to a difference between forward and backward printing in the position at which the previously impacted ink is sucked into the dye sucking layer. Specifically, the tint difference during reciprocatory printing increases with a difference in suction point between forward printing and backward printing. In the applicants' experiments, the cyan ink had a suction point closest to the front layer among the four colors used, while the magenta ink tended to sink deep through the medium toward its bottom layer. Regardless of the hue difference between the ink colors described previously, the ink colors having the largest difference in dye suction point between them are arranged so as to have the largest inter-color distance between them.

As described above, the color non-uniformity during reciprocatory printing can be reduced by arranging the two ink colors having the largest hue difference and the largest difference in dye suction point between them so that the ink colors have the largest inter-nozzle-row distance.

As described above, according to the present embodiment, when a printing operation is performed using the printing section (ink ejection section) including the color nozzle rows corresponding to the four colors, the nozzle rows for the two colors (in the present embodiment, C and M) having the largest hue difference among the plurality of colors are arranged at the opposite ends of the printing section in the main scanning direction so that these two colors have a relatively large difference in impacting time. This increases the difference in impacting time between the two colors (C and M) having the largest hue difference. This in turn reduces the tint difference caused by a difference in ink overlapping order between a forward scan and a backward scan.

From a different viewpoint, in the present embodiment, the color nozzle rows are arranged in the direction orthogonal to the nozzle arrangement direction so that between the nozzle rows for the two colors having the largest hue difference, two or more nozzle rows for colors other than the above two colors are arranged. This increases the difference in impacting time between the two colors (C and M) having the largest hue difference. It is thus possible to reduce the tint difference caused by a difference in ink overlapping order between a forward scan and a backward scan.

Furthermore, the present embodiment takes into consideration the fact that the black ink is rarely used to form a secondary color. Thus, when a printing operation is performed using the printing section (ink ejecting section) including the color nozzle rows corresponding to the four colors including black, the nozzle rows for two (C and M) of the three colors excluding black are arranged at the largest distance from each other among the color nozzle rows so that these two colors have a relatively large difference in impacting time between them. This increases the difference in impacting time between the two colors (C and M) having the largest hue difference. This in turn reduces the tint difference caused by a difference in ink overlapping order between a forward scan and a backward scan.

Embodiment 2

In the description of Embodiment 1, the four color inks, i.e. the cyan, magenta, yellow, and black inks are used. However, 6-color ink jet printing apparatuses are also popular which use the above four color inks with two additional inks, light cyan and magenta inks, in order to improve image quality. Thus, in the present embodiment, this 6-color arrangement will be described.

Figure 7:
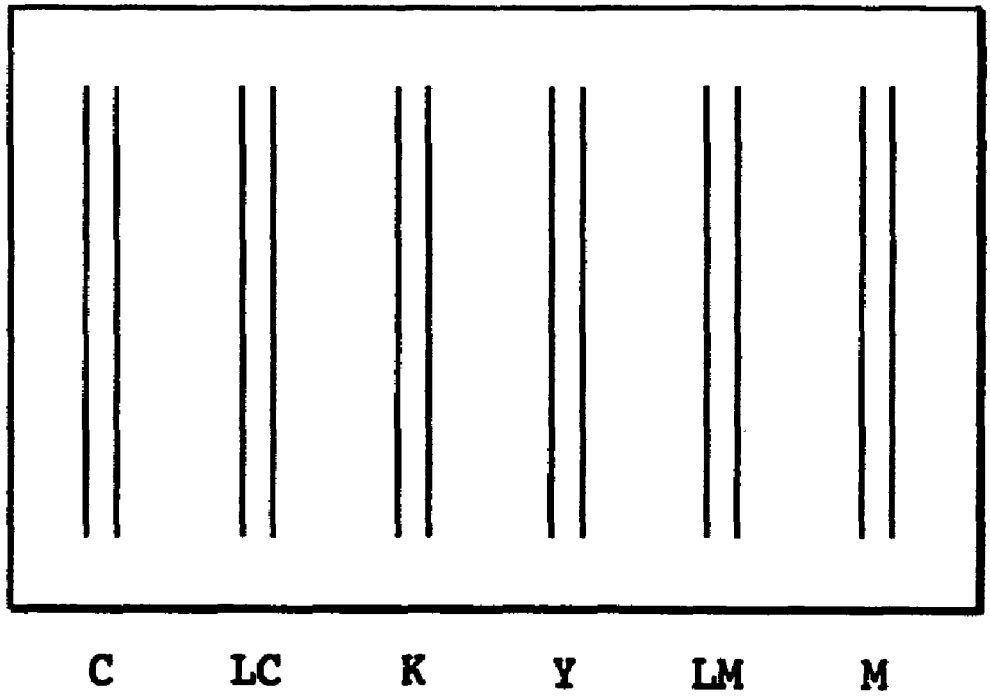
FIG. 7 is a schematic view showing an arrangement of nozzle rows in a print head according to Embodiment 2.

The configuration of the ink jet printing apparatus is similar to that in Embodiment 1. However, the configuration of the print head is as shown in FIG. 7. This figure is a schematic view showing an arrangement of color nozzle rows in a print head according to the present embodiment. As is apparent from FIG. 7, in the direction orthogonal to the nozzle arrangement direction, the color nozzle rows are arranged in the order of cyan (C), light cyan (LC), black (K), yellow (Y), light magenta (LM), and magenta (M). Also in this embodiment, in between the nozzle rows for the two colors (cyan and magenta) having the largest hue difference among the plurality of colors, at least two nozzle rows for the colors other that the above two colors (cyan and magenta) are arranged. This results in a relatively large difference in ink impacting time between the two colors having the largest hue difference.

Figure 8:
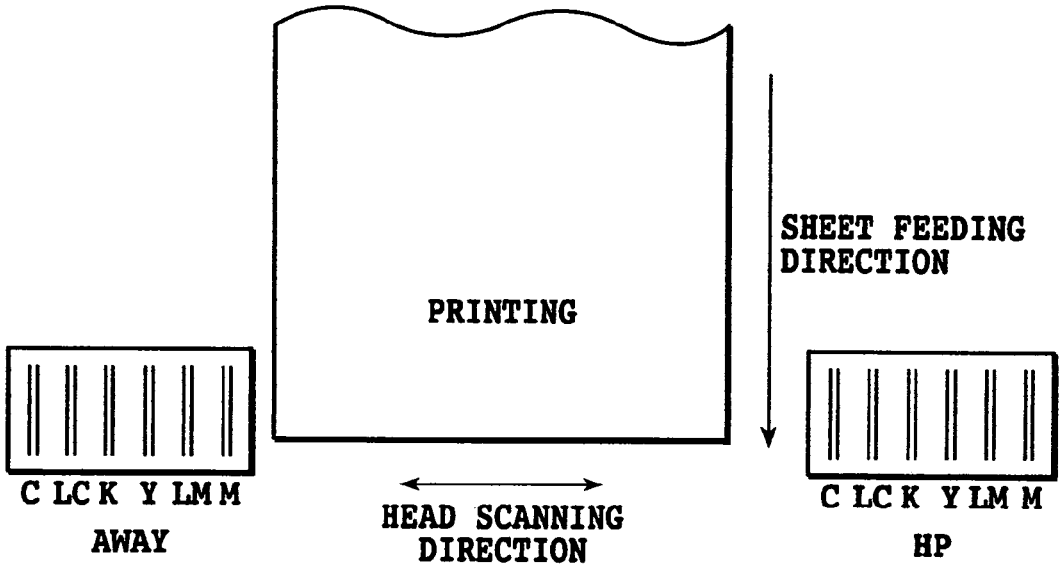
FIG. 8 is a schematic view showing the relationship between a scanning direction and the print head according to Embodiment 2.

FIG. 8 is a schematic view showing an arrangement of the color nozzle rows in the main scanning direction of the printhead. The color nozzle rows are arranged parallel with one another at equal intervals in the order of cyan (C), light cyan (LC), black (K), yellow (Y), light magenta (LM), and magenta (M) from a home position toward an away side. As with Embodiment 1, in the present embodiment, the nozzle rows for cyan and magenta, which have the largest hue difference, are arranged at the opposite ends in the main scanning direction so that cyan and magenta have the largest inter-color-distance between them. Here, the dark ink and the light ink normally have the same hue. Thus, in this case, those two of the dark inks having large tint differences between forward and backward printing which have the largest hue difference are preferably arranged at the largest distance from each other. As is apparent from FIG. 6, if the distance between adjacent nozzle rows is defined to be "1", then in the present embodiment, the distance between the cyan nozzle row and magenta nozzle row in the printing section is "5".

As shown in FIG. 6, if the inter-nozzle-row distance is "5", the tint distance caused by a difference in ink overlapping order decreases sharply. For example, in the print head according to Embodiment 1, the inter-nozzle-row distance between cyan and magenta is 3. Thus, the color difference in the present embodiment is much smaller than that in Embodiment 1.

With reference to FIG. 9, description will be given of two of the six color inks C, LC, K, Y, LM, and M which effectively have their inter-nozzle-row distance increased.

FIG. 9 shows allowable values for the inter-nozzle-row distance between arbitrary two of five colors, cyan, magenta, yellow, light cyan, and light magenta, as well as the results of subjective evaluation of "color non-uniformity" observed when a solid image composed of a secondary color obtained by the corresponding two colors is printed by bidirectional scanning. As is apparent from FIG. 9, when cyan was defined as a reference, magenta had to be arranged at the largest inter-color distance from cyan. Similarly, the relationship between the inter-color distance and the color non-uniformity was examined using other ink colors (light cyan, magenta, and light magenta) as a reference. Then, it was also found that the largest inter-color distance is required between cyan and magenta.

Accordingly, when six ink colors are arranged in the horizontal direction of the head, it is most effective to arrange magenta and cyan at the outermost positions in preventing image quality from being degraded by color non-uniformity. The black ink is excluded because compared to other color inks, it is rare to use black and another color to form a secondary color. Further, when the black ink is used with a high duty, the other inks have low duties. In contrast, when the other inks have high duties, the black ink has a low duty. Consequently, in principle, the color non-uniformity is unnoticeable during reciprocatory printing. Therefore, the black ink is excluded from the combinations. Furthermore, light cyan is arranged adjacent to cyan, and light magenta is arranged adjacent to magenta. This is because in image design, it is hardly possible that dark and light inks of the same hue are simultaneously printed with high duties close to 100%, so that in view of an increase in the temperature of the print head, the dark and light inks of the same hue are preferably arranged in proximity, with the other inks arranged between pairs each of dark and light inks of the same hue.

Further, also described in Embodiment 1, attention must be paid to the suction point of ink dye on the print medium. In the inventors' experiments, the cyan ink used had a suction point closest to the front layer, while the magenta ink tended to sink deep through the medium toward its bottom layer. Thus, the ink colors having the largest difference in dye suction point between them must be arranged so as to have the largest inter-color distance between them even if these ink colors have equivalent hues. Also in this case, by further separating cyan and magenta from each other, effective results are obtained in terms of the dye suction point.

As described above, in the head in which the six color ink nozzle rows are arranged in the horizontal direction, the inks having the largest color difference based on the ink overlapping order during reciprocatory printing, i.e. the cyan and magenta inks in the present embodiment, are arranged so as to have the largest inter-nozzle-row distance between them. Further, for the other ink colors, the nozzle rows are arranged on the basis of the inter-nozzle-row distance that limits the color non-uniformity to an allowable value. This reduces the color non-uniformity during reciprocatory printing.

As described above, according to the present embodiment, when a printing operation is performed using the printing section (ink ejection section) including the color nozzle rows corresponding to the six colors, the nozzle rows for the two colors (in the present embodiment, C and M) having the largest hue difference among the plurality of colors are arranged at the opposite ends of the printing section in the main scanning direction so that these two colors have a relatively large difference in impacting time. This increases the difference in impacting time between the two colors (C and M) having the largest hue difference. This in turn reduces the tint difference caused by a difference in ink overlapping order between a forward scan and a backward scan.

Embodiment 3

In general, printing apparatuses are relatively likely to print monochrome images such as documents. Thus, the amount of black ink used is larger than that of color inks used. Accordingly, printing apparatuses are provided in which a black ink tank has a larger capacity than color ink tanks in order to reduce the number of times inks must be replaced. In this case, the black ink tank arranged at the outermost position improves the usability of the apparatus, for example, facilitates the replacement of the tanks. Further, the ink tanks are preferably connected straight to a head having a plurality of color nozzle rows because the length of ink channels formed can be minimized.

In the present embodiment, description will be given of a print head with an optimum arrangement in which a black ink nozzle row is arranged at the outermost position and in which a tint difference caused by a difference in color overlapping order can be minimized for the other color inks (cyan, light cyan, yellow, light magenta, and magenta).

Figure 10:
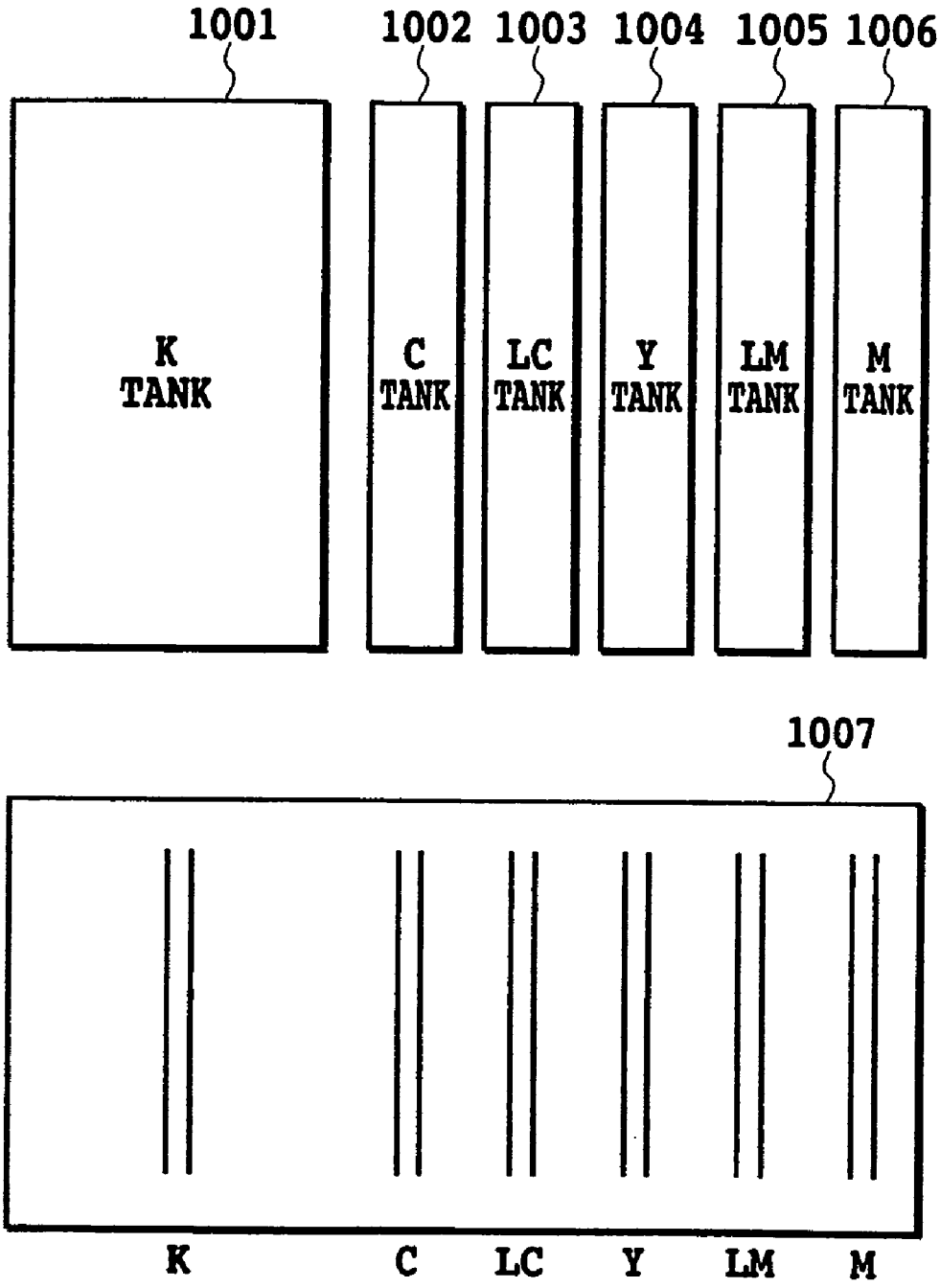
FIG. 10 is a schematic view showing ink tanks and nozzle rows according to Embodiment 3.
Figure 11A:
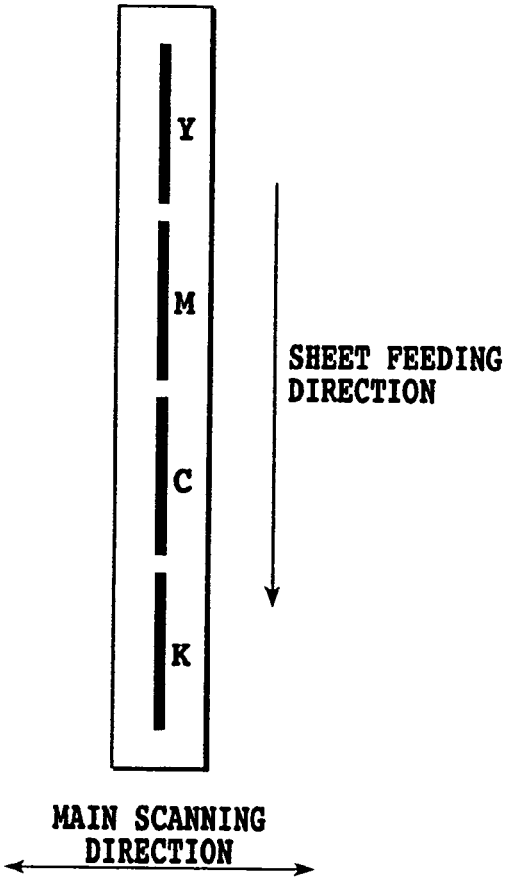
FIGS. 11A and 11B are schematic views showing examples of conventional vertically arranged print heads.
Figure 11B:
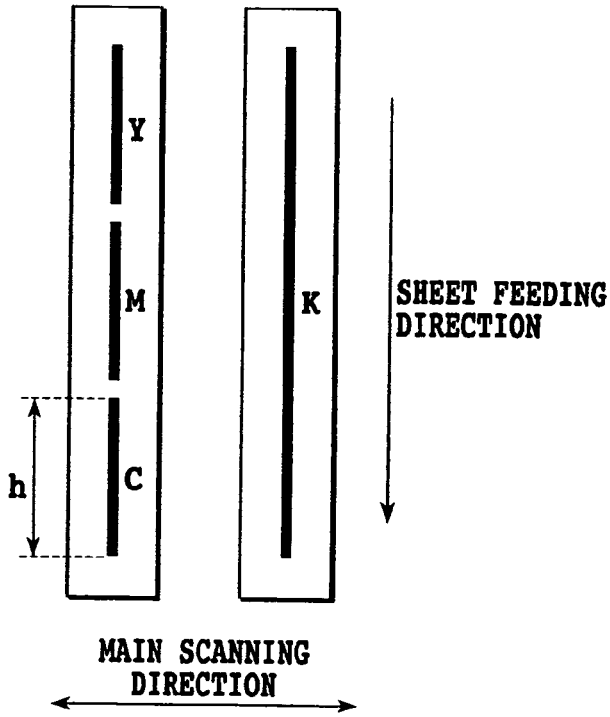
Figure 12:
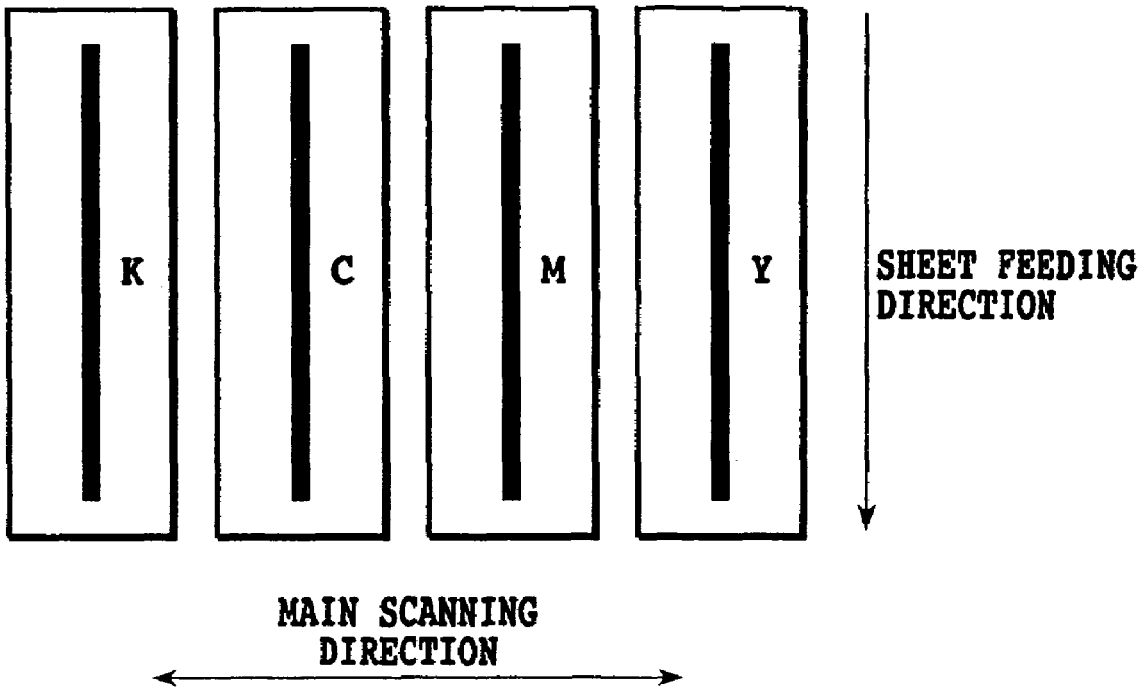
FIG. 12 is a schematic view showing an example of a conventional horizontally arranged print head.
Figure 12:
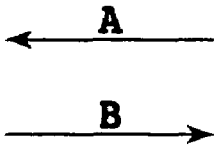
Figure 13:
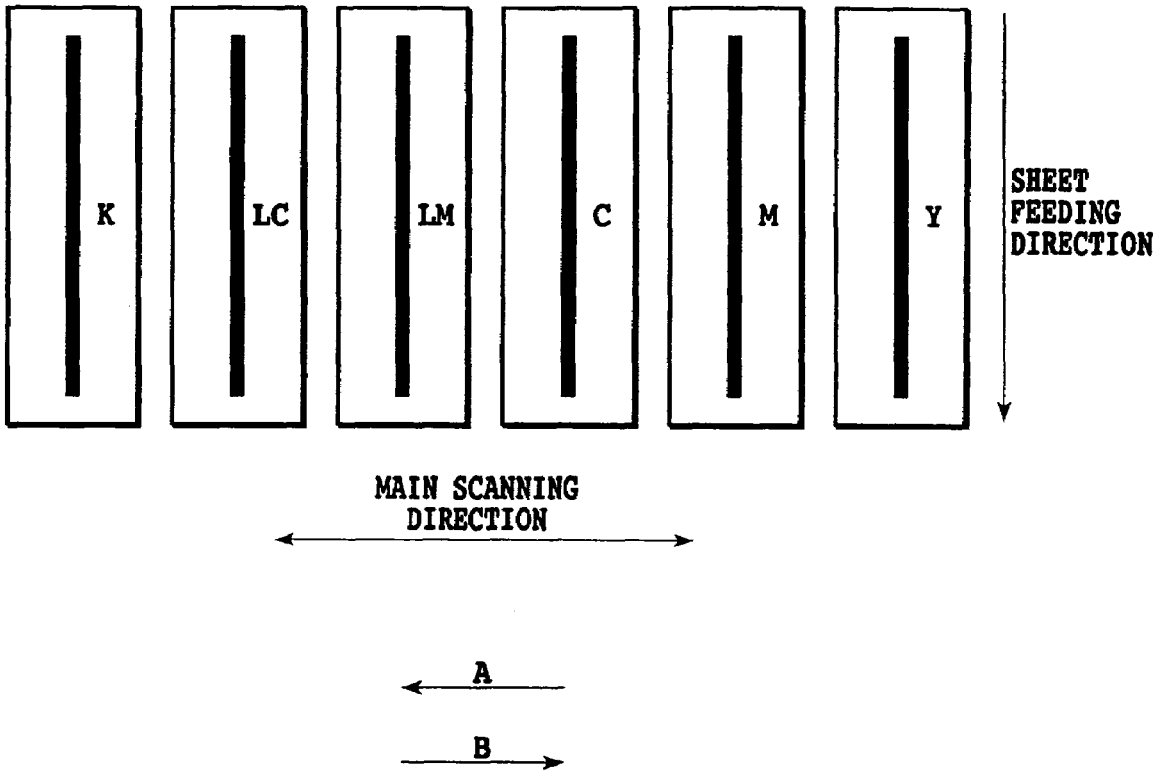
FIG. 13 is a schematic view showing another example of a conventional horizontally arranged print head.

FIG. 10 is a schematic view showing the arrangement order of colors in the head according to the present embodiment and the corresponding ink tanks. Ink channels are advantageously formed by connecting ink tanks 1001 to 1006 straight to a head chip 1007 having nozzle rows for a plurality of colors. Accordingly, on the head chip, the black ink nozzle row is arranged at the outermost position.

In order to suppress color non-uniformity caused by reciprocatory printing, the remaining five color nozzle rows are arranged so that cyan and magenta have a larger inter-nozzle-row distance than the other colors as also described in Embodiments 1 and 2. Accordingly, in the main scanning direction, color ink ejecting nozzle rows are arranged in the order of cyan, light cyan, yellow, light magenta, and magenta. These nozzle rows are arranged at equal intervals in the main scanning direction. When the distance between adjacent nozzle rows is defined to be "1" the distance between cyan and magenta is "4". This distance is sufficient to provide a time difference required to suppress a color difference resulting from a difference in ink overlapping order. Consequently, a print head of such a configuration can suppress "color non uniformity" attributed to a color difference caused by a difference in ink overlapping order as with Embodiments 1 and 2. Furthermore, since the ink tanks and the nozzle rows can be arranged straight, complicated ink channels need not be formed in the head chip. This prevents reliability from being degraded by a complicated structure.

The present embodiment produces effects similar to those of Embodiments 1 and 2 in spite of the outermost arrangement of the black ink. This is partly because compared to the other color inks, it is rare to use black and another color to form a secondary color. Further, when the black ink is used with a high duty, the other inks have low duties. In contrast, when the other inks have high duties, the black ink has a low duty. Consequently, in principle, the color non-uniformity is unnoticeable during reciprocatory printing.

The configuration according to the present embodiment provides a color arrangement order that avoids striking the user as incongruous. It also makes it possible to avoid the color non-uniformity during reciprocatory printing and prevent the reliability from being degraded by the complicated formation of channels.

As described above, in the present embodiment, since the black ink is rarely used to form a secondary color, when a printing operation is performed using the printing section (ink ejection section) including the color nozzle rows corresponding to the six colors, the nozzle rows for the two colors (in the present embodiment, C and M) having the largest hue difference among the five colors excluding black are arranged at the opposite ends of the printing section in the main scanning direction so that these two colors have a relatively large difference in impacting time. This increases the difference in impacting time between the two colors (C and M) having the largest hue difference. This in turn reduces the tint difference caused by a difference in ink overlapping order between a forward scan and a backward scan.

Embodiment 4

In Embodiments 1 to 3, described above, the nozzle rows (C and M nozzle rows) for colors having the largest hue difference are arranged at the largest distance from each other among the color nozzle rows. However, the present invention is not limited to this aspect. At least two nozzle rows have only to be arranged between the nozzle rows for colors having the largest hue difference. This will be described below.

In Embodiment 1, described above, the two nozzle rows (K and Y nozzle rows) are arranged between the nozzle rows (C and M nozzle rows) for the two colors having the largest hue difference. In Embodiment 2, the four nozzle rows (K, Y, LM, and LC nozzle rows) are arranged between the nozzle rows (C and M nozzle rows) for the two colors having the largest hue difference. Further, in Embodiment 3, the three nozzle rows (Y, LM, and LC nozzle rows) are arranged between the nozzle rows (C and M nozzle rows) for the two colors having the largest hue difference. Certainly, it is most effective to arrange the nozzle rows (C and M nozzle rows) for the two colors having the largest hue difference, at the largest distance from each other among the color nozzle rows, in reducing the hue difference.

However, the color difference can be reduced without using the arrangement in which the nozzle rows (C and M nozzle rows) for the two colors having the largest hue difference are arranged at the largest distance from each other among the color nozzle rows. For example, in Embodiment 2, the four nozzle rows (K, Y, LM, and LC nozzle rows) are arranged between the nozzle rows (C and M nozzle rows) for the two colors having the largest hue difference. However, the tint difference reduction effect can be produced without using the arrangement in which the four nozzle rows are sandwiched between the two other nozzle rows. For example, it is possible to use the arrangement in which the two nozzle rows are sandwiched between the two other nozzle rows as in Embodiment 1 or the arrangement in which the three nozzle rows are sandwiched between the two other nozzle rows as in Embodiment 3. That is, the tint difference can be reduced using the arrangement in which the two nozzle rows are arranged between the nozzle rows for the two colors having the largest hue difference (i.e. the arrangement having an inter-nozzle-row distance of "3" as in FIG. 6). Accordingly, a tint difference reduction effect similar to that of Embodiment 1 can be produced by employing the above arrangement in a 6-color configuration such as the one of Embodiment 2. In view of Embodiments 1 to 3 and FIG. 6, it is clear that at least two nozzle rows must be arranged between the two nozzle rows having the largest hue difference. In other words, the tint difference reduction effect can be produced by employing the arrangement in which at least two nozzle rows must be arranged between the two nozzle rows having the largest hue difference.

Other Embodiments

In the above description of Embodiments 1 to 4, the printing section (ink ejecting section) is provided with the color nozzle rows corresponding to the four or six colors. However, the present invention is not limited to the four or six colors. For example, it is possible to use a 7-color arrangement using the previously described six colors and light black, or an arrangement using the previously described six colors and another ink (for example, dark yellow). Further, in the above description of Embodiments 1 to 4, C, M, Y, K, LC, and LM are taken as examples of ink colors used. However, the present invention is not limited to these ink colors. For example, light black, light yellow, blue, orange, or the like may be used. In either way, the printing section (ink ejecting section) may be configured so that in the direction orthogonal to the nozzle arrangement direction, between the nozzle rows for the two colors having the largest color difference, at least two nozzle rows for colors other than the above two colors are arranged or may be configured so that the nozzle rows for the two colors having the largest hue difference are arranged at the opposite ends in the direction orthogonal to the nozzle arrangement direction.

Further, in Embodiments 2 to 4, described above, all the nozzle rows used are integrated together in the head. However, the present invention is not limited to this aspect. The color nozzle rows may be provided in different print heads. Specifically, in Embodiments 2 to 4, described above, the six color nozzle rows corresponding to cyan (C), magenta (M), yellow (Y), black (K), light cyan (LC), and light magenta (LM) are provided in one print head. However, these six color nozzle rows may be independently provided in different print heads. In this case, one color nozzle row is provided in each print head. Accordingly, six print heads are used in total. Furthermore, one of the six color nozzle rows for a particular color (for example, K) may be provided in one of two print heads, whereas the five color nozzle rows for the other colors (for example, C, M, Y, LC, and LM) may be provided in the other print head.

Further, in Embodiments 2 to 4, described above, the six color nozzle rows are formed in one chip of the same print head. However, the present invention is not limited to this aspect. The color nozzle rows may be formed in different chips of the same print head. Specifically, in Embodiments 2 to 4, described above, the six color nozzle rows corresponding to cyan (C), magenta (M), yellow (Y), black (K), light cyan (LC), and light magenta (LM) are provided in one chip of one print head. However, these six nozzle rows may be independently provided in different chips. In this case, one color nozzle row is provided in each chip. Accordingly, six chips are used in total. Furthermore, one of the six color nozzle rows for a particular color (for example, K) may be provided in one of two chips, whereas the five color nozzle rows for the other colors (for example, C, M, Y, LC, and LM) may be provided in the other chip. Alternatively, the six colors may be divided into three arbitrary pairs (for example, C and LC, K and Y, and LM and M) so that the nozzle rows corresponding to these three pairs can be provided in three different chips. If the color nozzle rows included in the printing section (or ink ejecting section) are provided in different print heads, then it should be appreciated that at least one of the color nozzle rows is provided in a different chip.

As described above, according to the present invention, if a secondary color is formed using two colors having the largest hue difference, a sufficient time is available after previously ejected ink has impacted a print medium and before subsequently ejected ink impacts the print medium. This sufficiently suppresses "color non-uniformity" caused by a difference in ink overlapping order during reciprocatory printing.

The present invention has been described in detail with respect to preferred embodiments, and it will now be apparent from the foregoing to those skilled in the art that changes and modifications may be made without departing from the invention in its broader aspects, and it is the intention, therefore that the appended claims cover all such changes and modifications as fall within the true spirit of the invention.

What is claimed is:

1. An ink jet printing apparatus that prints on a print medium by causing a printing section, including a plurality of nozzle rows respectively corresponding to a plurality of four or more ink colors, to carry out a main scan in a main scanning direction, while causing said printing section to eject ink onto the print medium, wherein a first ink color and a second ink color respectively correspond to two ink colors among the plurality of four or more ink colors having the greatest hue difference between them, and wherein a nozzle row corresponding to the first ink color is arranged at one extreme end of said printing section in the main scanning direction and a nozzle row corresponding to the second ink color is arranged at the other extreme end of said printing section in the main scanning direction.

2. An ink jet printing apparatus according to claim 1, wherein said nozzle rows of said printing section include a nozzle row for cyan ink, a nozzle row for black ink, a nozzle row for yellow ink, and a nozzle row for magenta ink, and said nozzle row corresponding to the first ink color is the nozzle row corresponding to cyan ink, and said nozzle row corresponding to the second ink color is the nozzle row for corresponding to magenta ink.

3. An ink jet printing apparatus according to claim 1, wherein the nozzle rows of said printing section include nozzle rows through which inks having the same color but different densities are ejected, and said nozzle rows for the inks having the same color but different densities are arranged adjacent to each other in the main direction.

4. An ink jet printing apparatus according to claim 1, wherein when a secondary color dot is formed on the print medium by ejecting ink during both a forward main scan of said printing section and a backward main scan of said printing section, an ink overlapping order is different between the printing in the forward main scan and the printing in the backward main scan.

5. An ink jet printing apparatus that prints on a print medium by causing a printing section, comprising a plurality of nozzle rows respectively corresponding to a plurality of ink colors including black ink, to carry out a main scan in a main scanning direction, while causing said printing section to eject ink onto the print medium, wherein a first ink color and a second ink color respectively correspond to two ink colors among the plurality of ink colors, other than the black ink, having the greatest hue difference between them, and wherein a nozzle row corresponding to the first ink color is arranged at one extreme end of said printing section in the main scanning direction, a nozzle row corresponding to the second ink color is arranged at the other extreme end of said printing section in the main scanning direction, and a nozzle row corresponding to the black ink is positioned between said nozzle row corresponding to the first ink color and said nozzle row corresponding to the second ink color.

6. An ink jet printing apparatus that prints on a print medium by causing a printing section, comprising a plurality of nozzle rows respectively corresponding to a plurality of ink colors including black ink, to carry out a main scan in a main scanning direction, while causing said printing section to eject ink onto the print medium, wherein a first ink color and a second ink color respectively correspond to two ink colors among the plurality of ink colors having the greatest hue difference between them, and wherein a nozzle row corresponding to the first ink color is arranged at one extreme end of said printing section in the main scanning direction and a nozzle row corresponding to the second ink color is arranged at the other extreme end of said printing section in the main scanning direction.

7. An ink jet printing method of printing on a print medium by causing a printing section, including a plurality of nozzle rows respectively corresponding to a plurality of four or more ink colors, to carry out a main scan in a main scanning direction, while causing the printing section to eject ink onto the print medium, wherein a first ink color and a second ink color respectively correspond to two ink colors among the plurality of four or more ink colors having the greatest hue difference between them, and wherein a nozzle row corresponding to the first ink color is arranged at one extreme end of the printing section in a main scanning direction and a nozzle row corresponding to the second ink color is arranged at the other extreme end of the printing section in the main scanning direction.

8. An ink jet printing method of printing on a print medium by causing a printing section, comprising a plurality of nozzle rows respectively corresponding to a plurality of ink colors including black ink, to carry out a main scan in a main scanning direction, while causing the printing section to eject ink onto the print medium, wherein a first ink color and a second ink color respectively correspond to two ink colors among the plurality of ink colors, other than the black ink, having the greatest hue difference between them, and wherein a nozzle row corresponding to the first ink color is arranged at one extreme end of the printing section in the main scanning direction, a nozzle row corresponding to the second ink color is arranged at the other extreme end of the printing section in the main scanning direction, and a nozzle row corresponding to the black ink is positioned between the nozzle row corresponding to the first ink color and the nozzle row corresponding to the second ink color.

9. An ink jet printing method of printing on a print medium by causing a printing section, comprising a plurality of nozzle rows respectively corresponding to a plurality of ink colors including black ink, to carry out a main scan in a main scanning direction, while causing the printing section to eject ink onto the print medium, wherein a first ink color and a second ink color respectively correspond to two ink colors among the plurality of ink colors having the greatest hue difference between them, and wherein a nozzle row corresponding to the first ink color is arranged at one extreme end of the printing section in the main scanning direction, and a nozzle row corresponding to the second ink color is arranged at the other extreme end of the printing section in the main scanning direction.

10. An ink jet print head including a plurality of nozzle rows corresponding to a plurality of four or more ink colors, respectively, wherein a first ink color and a second ink color respectively correspond to two ink colors among the plurality of four or more ink colors having the greatest hue difference between them, wherein each of said nozzle rows is composed of a plurality of nozzles arranged in a first direction, and wherein a nozzle row corresponding to the first ink color is arranged at one extreme end of said print head in a second direction orthogonal to the first direction and a nozzle row corresponding to the second ink color is arranged at the other extreme end of said print head in the second direction.

11. An ink jet print head comprising a plurality of nozzle rows corresponding to a plurality of ink colors including black ink, respectively, wherein a first ink color and a second ink color respectively correspond to two ink colors among the plurality of ink colors, other than the black ink, having the greatest hue difference between them, wherein each of said nozzle rows is composed of a plurality of nozzles arranged in a first direction, and wherein a nozzle row corresponding to the first ink color is arranged at one extreme end of said print head in a second direction orthogonal to the first direction, a nozzle row corresponding to the second ink color is arranged at the other extreme end of said print head in the second direction, and a nozzle row corresponding to the black ink is positioned between said nozzle row corresponding to the first ink color and said nozzle row corresponding to the second ink color.

12. An ink jet print head comprising a plurality of nozzle rows corresponding to a plurality of ink colors including black ink, respectively, wherein a first ink color and a second ink color respectively correspond to two ink colors among the plurality of ink colors having the greatest hue difference between them, wherein each of said nozzle rows is composed of a plurality of nozzles arranged in a first direction, and wherein a nozzle row corresponding to the first ink color is arranged at one extreme end of said print head along a second direction orthogonal to the first direction, and a nozzle row corresponding to the second ink color is arranged at the other extreme end of said print head along the second direction.

13. An ink jet printing method of printing on a print medium by causing a printing section, provided with a plurality of nozzle rows corresponding to a plurality of ink colors respectively, to carry out a main scan in a main scanning direction orthogonal to a predetermined direction, while causing the printing section to eject ink onto the print medium during the main scan, wherein a first ink color and a second ink color respectively correspond to two ink colors having the greatest color difference between an image obtained during a forward main scan and an image obtained during a backward main scan using two arbitrary colors of the plurality of ink colors, and wherein a nozzle row corresponding to the first ink color is arranged at one extreme end of the printing section in the main scanning direction and a nozzle row corresponding to the second ink color is arranged at the other extreme end of the printing section in the main scanning direction.

14. An ink jet printing method of printing on a print medium by causing a printing section, including a black nozzle row corresponding to black ink and a plurality of nozzle rows respectively corresponding to a plurality of ink colors other than black, to carry out a main scan in a main scanning direction, while causing the printing section to eject ink onto the print medium during the main scan, wherein a first ink color and a second ink color respectively correspond to two ink colors having the greatest color difference between an image obtained during a forward main scan and an image obtained during a backward main scan using two arbitrary colors of the plurality of ink colors, and wherein a nozzle row corresponding to the first ink color is arranged at one extreme end of the printing section in the main scanning direction and a nozzle row corresponding to the second ink color is arranged at the other extreme end of the printing section in the main scanning direction.

* * * * *